United States Patent [19]

Soya et al.

[11] 3,981,946

[45] Sept. 21, 1976

[54] PERFORATED PLATE OF STEAM REFORMING VALVE

[75] Inventors: Masahiro Soya, Kawasaki; Shokichi Kubota, Matsudo, both of Japan

[73] Assignee: Tokico Ltd., Kawasaki, Japan

[22] Filed: Feb. 5, 1975

[21] Appl. No.: 547,406

[30] Foreign Application Priority Data

Feb. 12, 1974 Japan ..... 49-16301
Feb. 12, 1974 Japan ..... 49-16302

[52] U.S. Cl. ..... 261/64 R; 261/76; 261/118; 261/DIG. 13

[51] Int. Cl.[2] ..... B01F 3/04

[58] Field of Search ..... 261/DIG. 13, 76, 78 R, 261/64, 118; 122/487; 239/553.3, 559

[56] References Cited

UNITED STATES PATENTS 3,219,325 11/1965 Brown ..... 261/DIG. 13 X
3,235,344 2/1966 Dreyer et al. ..... 261/64 R X
3,409,274 11/1968 Lawton ..... 261/76 X

*Primary Examiner*—Frank W. Lutter
*Assistant Examiner*—William Cuchlinski, Jr.
*Attorney, Agent, or Firm*—Haseltine, Lake & Waters

[57] ABSTRACT

In a steam reforming valve having pressure-reducing valve means for reducing the pressure of superheated steam at high temperature and high pressure and temperature reducing means for reducing the temperature of said superheated steam by spraying water thereinto, a perforated plate comprises a part fixed to a main structure of the steam reforming valve on the downstream side of the temperature reducing means with respect to the direction of flow of the steam within the main structure and a disc part held by the fixed part and having a plurality of through-holes for passing therethrough steam and sprayed water. The disc part is of a construction whereby it has a free end relative to the fixed part.

4 Claims, 8 Drawing Figures

PERFORATED PLATE OF STEAM REFORMING VALVE

BACKGROUND OF THE INVENTION

This invention relates generally to a perforated plate of a steam reforming valve for reducing the pressure of steam at high temperature and high pressure, at the same time mixing the steam with water thereby to reduce the steam temperature, and thus reforming the steam into low temperature and low pressure steam. More specifically, the invention relates to a perforated plate installed in a steam reforming valve of the above defined class and operating when the steam mixed with water passes therethrough to agitate the mixture.

In a steam reforming valve for reforming steam at high temperature and high pressure into steam at low temperature and low pressure, in general, steam mixed with water is further agitated and rendered into uniform low temperature and low pressure steam. For this purpose, a perforated plate having numerous through-holes is provided in the valve.

When steam at high temperature and water which have not yet been mixed throughly pass through a perforated plate, high temperature steam and water at low temperature impinge on the surface of the perforated valve and cause great temperature differences to occur at various parts of this perforated plate surface. As a consequence, these parts of the perforated plate fixed to the main structure of the steam reforming valve undergo expansion and contraction, whereby thermal stresses develop. As a result, the perforated plate is subjected to fatigue and, if these thermal stresses become excessive, will be damaged.

Particularly in the prior art, perforated plates of this character have been of a construction wherein numerous holes are merely formed in a disc part, which is fixed to the casing structure of a steam reforming valve. For this reason, deformations due to temperature differences are not relieved or absorbed, whereby thermal stresses will occur and there has been the problem of damage and breakage due to thermal stresses.

SUMMARY OF THE INVENTION

Accordingly, it is a general object of the present invention to provide a novel and useful perforated plate in a steam reforming valve in which the above described problem has been overcome.

A specific object of the invention is to provide, in a steam reforming valve, a perforated plate so constructed and so adapted that it is capable of effectively absorbing and relieving thermal stresses generated by the impinging of high temperature steam and water against the surface of the perforated plate. By this provision of the invention damage or breakage due to thermal stresses of the perforated plate is prevented.

Another object of the invention is to provide, in a steam reforming valve, a perforated plate of a construction such as to relieve thermal stresses in the disc interior.

Still another object of the invention is to provide, in a steam reforming valve, a perforated plate of a construction such as to relieve thermal stresses in the peripheral part of the disc.

Other objects and further features of the invention will be apparent from the following detailed description with respect to preferred embodiments of the invention when read in conjunction with the accompanying drawings.

DETAILED DESCRIPTION

Figures 1, 6:
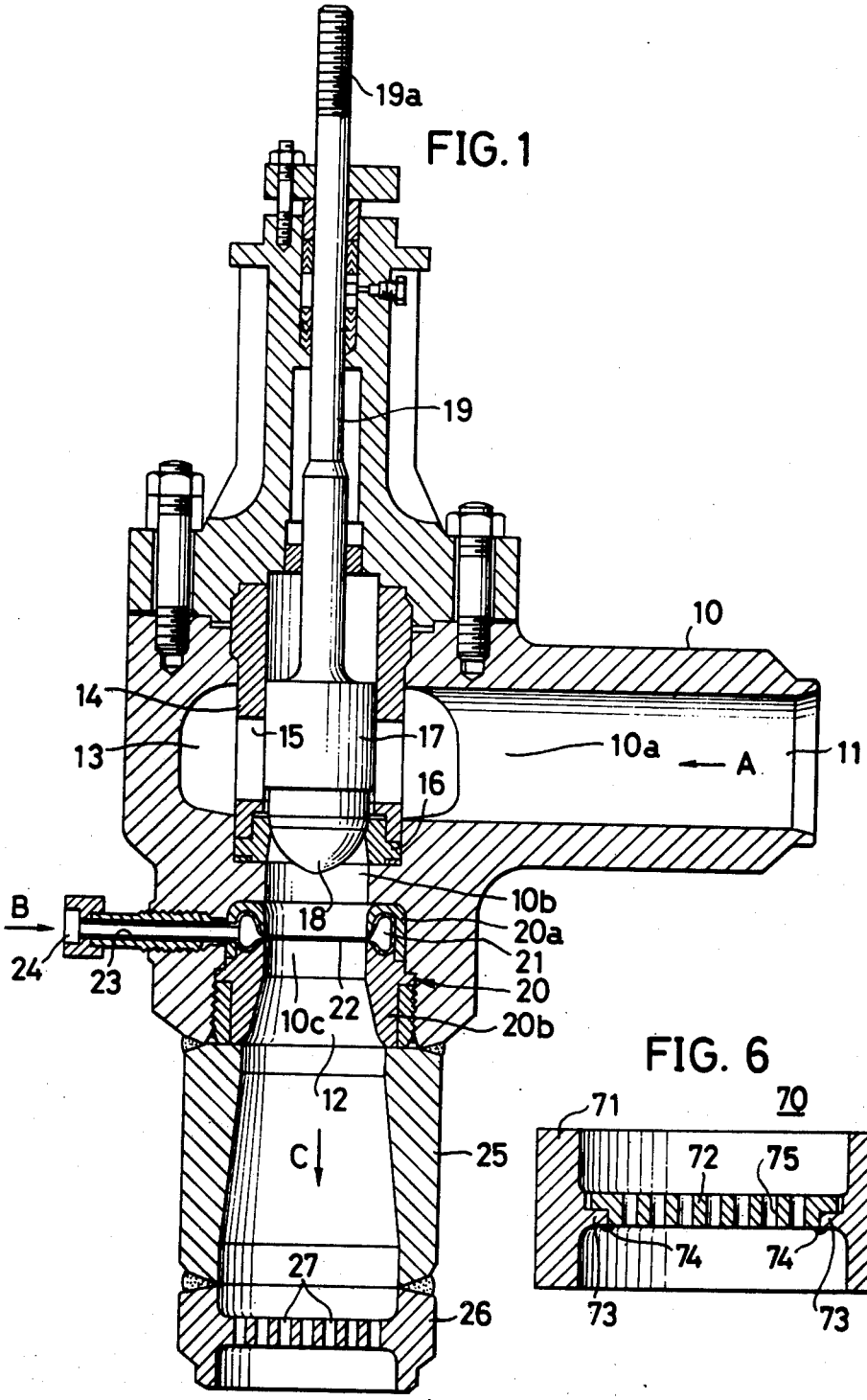
FIG. 1 is a side view, in longitudinal section, showing one example of a steam reforming valve in which the perforated plate of the invention can be applied.
FIG. 6 is a section taken along the axial centerline of a fifth embodiment of the perforated plate of the invention.

One example of a steam reforming valve in which a perforted plate according to this invention can be applied will first be described with reference to FIG. 1. The detailed construction of the steam reforming valve of this type is described in the specification of the copending U.S. patent application Ser. No. 383,515 filed on July 30, 1973, entitled "Steam Reforming Valve" and now issued on Sept. 9, 1975 as U.S. Pat. No. 3,904,722.

A casing structure 10 having a steam passageway 10*a* provided with a steam inlet 11 for introducing superheated steam at high temperature and high pressure from a lateral direction and steam passageways 10*b* and 10*c* extending in a direction perpendicular to the steam flowpath 10*a*. The passageway 10*c* is coaxially and contiguously connected to the passageway 10*b* and has a steam outlet 12 for conducting out steam which has been reformed, i.e., reduced in temperature and pressure, as described hereinafter. Between the passageways 10*a* and 10*b*, there is provided a chamber 13.

A sleeve-like cage 14 passing through the chamber 13 is tightly fitted in a hollow cavity of the valve casing structure 10 and, in its part passing through the chamber 13, has through-holes 15. Below the cage 14, a seat ring 16 constituting a valve seat is inserted into the casing structure 10. The axial centerline of the cage 14 coincides with the axial centerline of the steam passageways 10*b* and 10*c*.

Within the cage 14, there is inserted a valve plug 17 in a fluid-proof manner and in a manner to slide freely in the axial direction. At the lower end of the valve plug 17, there is formed integrally and coaxially therewith a valve body 18 adapted to seat against and separate from the abovementioned seat ring 16. A valve stem 19 is fixed coaxially to the upper part of the valve plug 17 and extends upward and out of the valve casing structure to an upper stem end 19*a*, which is coupled to an actuating device (not shown) such as a diaphragm actuator.

In a recess part of the casing structure 10 contiguous to the steam passageway 10*b*, an orifice forming member 20 of cylindrical shape is inserted and fixed. The orifice forming member 20 comprises two orifice forming half members 20*a* and 20*b*, which upon being assembled form the stem passageway 10*c*. Between the orifice forming half members 20*a* and 20*b*, there is formed an annular hollow space 21 which is communicative to the passageway 10*c* through a slit 22 formed between the orifice forming half members 20*a* and 20*b*. A water supply pipe 23 is passed transversely through the casing structure 10 to communicate at its inner end with the interior 21. The outer end of this pipe 42 is provided with a fitting 24 through which water for temperature reduction is supplied to flow in the arrow direction B through the pipe 23 and into the interior 21.

To the lower end of the casing structure 10, there is fixedly connected a reducer 25 having an interior communicating coaxially with steam outlet 12 and diverging with an inner diameter increasing with distance from the outlet 12. A perforated plate 26 provided with a large number of holes 27, which is described in detail hereinafter, is fixed to the downstream end of the reducer 25.

Primary-side superheated steam at a high temperature of, for example, from 400° to 530°C, and a high pressure of, for example, from 40 to 130 kg/cm$^2$, is supplied from a superheated steam source (not shown) and enters the steam reforming device through the inlet 11 to enter the passageway 10*a* and flow in the arrow direction A to the chamber 13.

Then, when the valve stem 19 is pulled upward, as viewed in the drawing, the valve plug 17 also is lifted unitarily with the stem 19, and the valve body 18 separates from the seat ring 16. Consequently, the primary-side steam which has entered the chamber 13 from the passageway 10*a* flows through the through-holes 15 and between the valve body 18 and the seat ring 16 and, being here throttled and reduced in pressure to a pressure of from 2 to 40 kg/cm$^2$, for example, flows at high velocity into the passageway 10*b*. Therefore, in the pressure reducing part formed by the valve body 18 and the seat ring 16, only pressure reduction of the primary side steam is carried out.

The pressure reduced steam which has flowed into the passageway 10*b* flows further at high velocity into the passageway 10*c*. Here, the inner diameter of the orifice half member 20*a* has been made smaller than that of the orifice half member 20*b*, whereby, in the orifice member 20, the orifice half member 20*a* forms a kind of Venturi tube construction or throat. As a consequence, the water within the interior 21 is sucked through the slit (orifice) 22 formed between the orifice half members 20*a* and 20*b* by the negative pressure produced by the steam flowing from the passageway 10*b* to the passageway 10*c* and past this Venturi throat at high velocity. The water is thus ejected as a fine spray by the resulting atomization action.

The above mentioned pressure reduced steam is mixed with the fine spray of water ejected through the slit (orifice) 22 and thereby reduced in temperature as it flows through the interior of the reducer 25 in the arrow direction C. This steam is further agitated in a positive manner by passing through the holes 27 of the perforated plate 26 and thereby uniformly reduced in temperature to from 150° to 300° C, for example. In this manner, secondary side steam at low pressure and low temperature which has been uniformly reduced in pressure and temperature to specific values is obtained on the downstream side of the perforated plate 26 after it has passed through the holes 27 thereof.

Figure 2A:
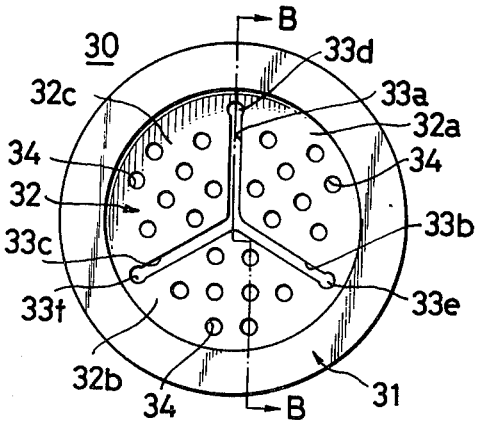
FIGS. 2A and 2B are respectively a plan view and a section taken along the line B—B in FIG. 2A showing a first embodiment of the perforated plate according to the invention.
Figure 2B:
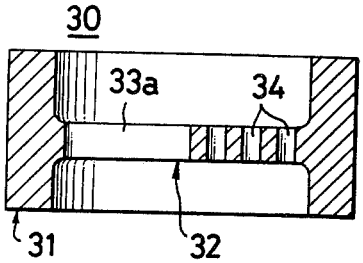

Next, a first embodiment of a perforated plate of the invention suitable for use as the above mentioned perforated plate 26 will be described with reference to FIG. 2.

The perforated plate 30 of this first embodiment of the invention comprises a cylindrical part 31 to be fixed to the lower end of the above mentioned reducer 25 and a disc part 32 integrally joined around its periphery to the inner wall surface of the cylindrical part 31. The disc part 32 is provided with slits 33*a*, 33*b*, and 33*c* formed therethrough and extending radially outward from the center of the disc part 32 with equal angular spacing therebetween. These slits 33*a* through 33*c* are mutually communicative at the center of the disc part 32 and terminate at their outer ends at points spaced by a very small distance from the inner wall surface of the cylindrical part 31, circular or bulbous hole parts 33*d*, 33*e*, and 33*f* of a diameter slightly greater than the width dimension (for example, 3 to 5 mm.) of the slits 33*a*, 33*b*, and 33*c* being formed at the outer ends of these slits. A plurality of through-holes 34 each of a diameter of the order of 6 to 10 mm., for example, are formed in each of the disc sectors 32*a*, 32*b*, and 32*c* of the disc part 32 divided by the slits 33*a*, 33*b*, and 33*c*. The dimensions such as the diameter and number of the holes 34 and the width of the slits 33*a*, 33*b*, and 33*c* are determined by considering factors such the flow rate of the steam to pass through these openings and the manner in which the steam and water are to be mixed.

Since the slits 33*a*, 33*b*, and 33*c* are formed in the disc part 32 in the above described manner, the edge parts of the disc sectors 32*a*, 32*b*, and 32*c* defining these slits 33*a*, 33*b*, and 33*c* are in the form of free ends. Accordingly, the disc sectors 32*a*, 32*b*, and 32*c* can be considered to be equivalent to cantilever beams supported at their outer parts contiguously joined to the cylindrical part 31.

When the cylindrical part 31 of the perforated plate 30 of the above described construction is affixed to the lower end of the reducer 25 of the steam reforming valve illustrated in FIG. 1, and the steam reforming valve is placed in its operational state, high temperature steam and water which have not yet been throughly mixed come in contact with the disc sectors 32*a*, 32*b*, and 32*c* of the perforated plate 30. Consequently, various parts of the disc sectors 32*a*, 32*b*, and 32*c* undergo thermal expansion or thermal contraction thereby to produce thermal deformations. However, since the disc sectors 32*a*, 32*b*, and 32*c* have the configuration of cantilever beams, their edges defining the slits 33*a*, 33*b*, and 33*c* being free ends, the thermal deformations thus produced are relieved at these free ends, and almost no thermal stress remains as an actual result. Accordingly, in the perforated plate of the invention, there is substantially no damage or breakage due to thermal stresses.

Figure 3:
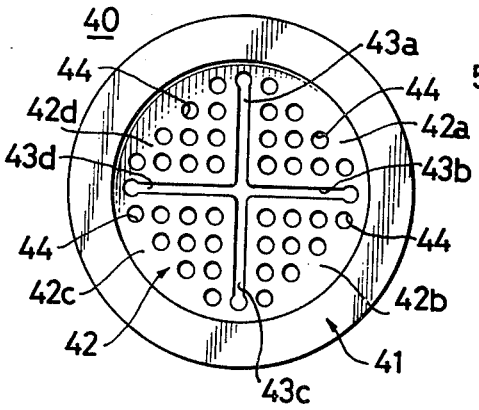
FIG. 3 is a plan view of a second embodiment of the perforated plate of the invention.

A second embodiment 40 of the perforated plate of the invention, as illustrated, in FIG. 3 comprises a cylindrical part 41 and a disc part 42 integrally joined around its periphery to the inner wall surface of the cylindrical part 41. The disc part 42 is provided with slits 43*a*, 43*b*, 43*c*, and 43*d* formed therethrough and extending radially outward from the center of the disc part 42 with equal angular spacing therebetween. These slits 43*a* through 43*d* are mutually communicative at their inner ends at the center of the disc part 42 and divide the disc part into four equal disc sectors 42*a*, 42*b*, 42*c*, and 42*d*, each of which is provided with a plurality of through-holes 44.

In this second embodiment also, similarly as in the preceding first embodiment, the edge parts of the disc sectors 42*a* through 42*d* defining the slits 43*a* through 43*d* constitute free ends, whereby practically no thermal stress is produced, and damage is prevented.

Figure 4:
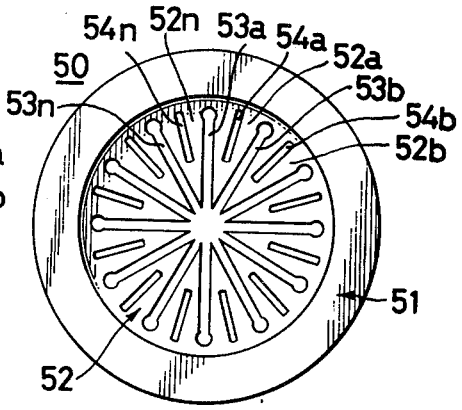
FIG. 4 is a plan view of a third embodiment of the perforated plate of the invention.

A third embodiment 50 of the perforated plate of the invention as illustrated in FIG. 4 comprises a cylindrical part 51 and a disc part 52 integrally joined around its periphery to the inner wall surface of the cylindrical part 51. The disc part 52 is provided with a plurality of slits 53*a* through 53*n* formed therethrough and extending radially in numerous directions of equal angular spacing from the center of the disc part 52. These slits 53*a* through 53*n* divide the disc part 52 into disc sectors 52*a* through 52*n*, which are respectively provided with circular holes or slits 54*a* through 54*n* formed therethrough. In this third embodiment also, steam and water are uniformly mixed when they pass through the slits 53*a* through 53*n* and the slits 54*a* through 54*n*.

In this embodiment also, the edges of the disc sectors 52*a* through 52*n* defining the slits 53*a* through 53*n* constitute free ends, whereby development of thermal stresses is effectively prevented similarly as in the preceding embodiments.

Figure 5A:
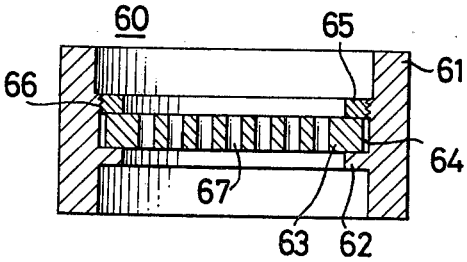
FIGS. 5A and 5B are respectively a section taken along the axial centerline and a plan view showing a fourth embodiment of the perforated plate of the invention.
Figure 5B:
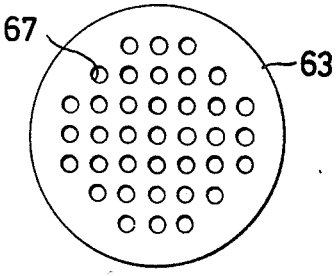

In a fourth embodiment of the perforated plate of the invention as illustrated in FIGS. 5A and 5B, a perforated plate 60 has a disc holder 61 of substantially cylindrical shaped provided around a part of its inner wall surface with an internal flange or annular shelf 62. A disc 63 of a diameter slightly less than the inner diameter of the holder 61 and greater than the inner diameter of the annular shelf 62 is supported on the annular shelf 62 with a small gap 64 existing between the periphery of the disc 63 and the inner wall surface of the holder 61. In this state, the disc 63 is held in place against the annular shelf 62 by a retaining member 65 having the shape of an annular ring and screw engaged with a tapped part 66 of the holder 61, the disc 63 being thus held between the retaining member 65 and the annular shelf 62. The disc 63 is provided with numerous holes 67 formed therethrough.

By the above described construction of this fourth embodiment of the perforated plate, the disc 63 is a separate structure relative to the holder 61, a gap 64 being formed therebetween, and peripheral edge of the disc is a free end. For this reason, even when the disc 63 is subjected to differences in temperature at different parts thereof, thermal stresses are effectively prevented from developing therein, and damage to the disc 63 due to thermal stresses is prevented.

In a fifth embodiment of the perforated plate of the invention as illustrated in FIG. 6, the perforated plate 70 comprises, essentially, a holder 71 of substantially cylindrical shape and a disc 72 perforated with holes 75. Around one part of the inner wall surface of the holder 71, there is integrally formed a stepped engagement part 73 projecting inward toward the center. The outer peripheral edge of the disc 72 is also formed with a stepped part for engagement with the stepped engagement part 73 of the holder 71. With the disc 72 fitted in place on the engagement part 73 and the stepped parts of the two parts in engagement, the outer peripheral edge part of the lower surface of the disc 72 and the inner edge part of the lower surface of the engagement part 73 are welded together at a part designated by reference numeral 74. These two parts are not fixed at other portions. Accordingly, the peripheral edge of the disc 72 on the upstream side thereof with respect to the flow of stream and water constitutes a free end, and only the peripheral edge of the disc 72 on the downstream side thereof is fixed to the holder 71.

Since the disc 72 is a separate structure relative to the holder 71 at portions other than the welded part 74, and the outer periphery thereof is a free end as described above, development of thermal stresses is effectively prevented.

In all of the above described embodiments, since there is practically no development of thermal stresses, the strength of the material (e.g., chromium molybdenum) of the perforated plate can be utilized at its maximum limit.

Further, this invention is not limited to these embodiments but various variations and modifications may be made without departing from the scope and spirit of the invention.

What is claimed is:

1. In a steam reforming valve having pressure reducing valve means for reducing the pressure of superheated steam at high temperature and high pressure and temperature reducing means for reducing the temperature of the superheated steam by spraying water thereinto, a perforated plate comprising: a part fixed to a main structural part of said valve on the downstream side of said temperature reducing means with respect to the direction of flow of the steam within said main structural part; and a disc part held by said fixed part and having a plurality of through-holes for passing steam and sprayed water therethrough, said disc part having an outer periphery formed integrally with said fixed part and has at the inner part thereof a plurality of through-slits mutually communicating at the central part of the disc part and extending outward toward said outer periphery, and edge parts of the disc part defining said slits constituting free end parts relative to said fixed part, whereby thermal stresses in the disc part can be relieved.

2. A perforated plate as claimed in claim 1 in which said slits are formed in directions to divide the disc part into three equal parts.

3. A perforated plate as claimed in claim 1 in which said slits are formed in directions to divide the disc part into four equal parts.

4. A perforated plate as claimed in claim 1 in which said slits are formed in large number in the disc part, and said through-holes are in the form of second slits formed in parts of the disc divided by adjacent slits.

* * * * *